US006003742A

United States Patent [19]

Garcia et al.

[11] Patent Number: 6,003,742

[45] Date of Patent: Dec. 21, 1999

[54] SPIGOT ACTUATING DEVICE

[76] Inventors: Daniel R. Garcia, 17905 SW. Pacific Hwy., Tualatin, Oreg. 97062; Gregory T. Kavounas, 99210 SW. Conestoga Dr. #199, Beaverton, Oreg. 97008

[21] Appl. No.: 09/000,504

[22] Filed: Dec. 30, 1997

[51] Int. Cl.[6] ..... B67D 3/00

[52] U.S. Cl. ..... 222/508; 222/517

[58] Field of Search ..... 222/505, 507–509, 222/92, 105, 402.15, 515, 517; 251/213, 231, 236, 228, 229, 243, 321; 141/346, 382, 383

[56] References Cited

U.S. PATENT DOCUMENTS

| | | | |
|---|---|---|---|
| Re. 32,354 | 2/1987 | Savage | 222/105 X |
| D. 317,351 | 6/1991 | Takeuchi | D23/265 |
| 2,941,700 | 6/1960 | Gable . | |
| 3,159,319 | 12/1964 | Parish . | |
| 3,313,516 | 4/1967 | Peterson . | |
| 3,314,577 | 4/1967 | Doblin . | |
| 3,478,938 | 11/1969 | Krause . | |
| 3,539,151 | 11/1970 | Reid et al. . | |
| 3,972,452 | 8/1976 | Welsh . | |
| 4,211,348 | 7/1980 | Scholle . | |
| 4,905,875 | 3/1990 | Straiton . | |
| 4,921,136 | 5/1990 | Roggenburg, Jr. . | |
| 4,927,061 | 5/1990 | Leigh et al. . | |
| 4,938,386 | 7/1990 | Roethel et al. . | |
| 5,074,441 | 12/1991 | Taguchi et al. . | |
| 5,203,056 | 4/1993 | Funk et al. | 251/10 |
| 5,402,919 | 4/1995 | Atkinson . | |
| 5,542,584 | 8/1996 | Konar . | |

*Primary Examiner*—Kevin Weldon
*Assistant Examiner*—Sean P. O'Hanlon
*Attorney, Agent, or Firm*—Marger Johnson & McCollom, P.C.

[57] ABSTRACT

An improved spigot actuating device is provided for actuating the spigot on a spout of bag-in-box potable liquids. The device comprises a collar for mounting onto a spout of a large standard diameter. A spacer is provided in the shape of an arcuate cuff, that makes all smaller spouts emulate the large standard diameter. The collar is flexible and resilient, arcuate, terminates in legs, and extends around the spout more than half way. The collar mounts graspingly the spout along a grasp arc that is larger than 180°, which makes for a secure attachment. Teeth are provided on the collar to render the attachment more secure. A pair of pinchers can be squeezed together to increase the separation between the legs, to permit mounting and removing the collar. The device further includes an actuator that is pivotable with respect to the collar around a rotation axis. The actuator has a handle for the user, and a cam with a specially designed upper surface. As the handle is rotated from a standby position, the upper surface engages the lever and pushes it open. In addition, design is such that the handle can be released at a full open position, where the egress path for the liquid is the widest possible.

15 Claims, 5 Drawing Sheets

SPIGOT ACTUATING DEVICE

BACKGROUND OF THE INVENTION

1. Field of the Invention

The present invention is related to the field of dispensing potable liquids from disposable containers that have a spigot supported by a projecting spout, and more particularly to an improved device for actuating the spigots of such containers.

2. Description of the Prior Art

Disposable "bag-in box" containers are in widespread commercial use for packaging various liquids including but not limited to milk, fruit juices, water and wine. Such containers typically consist of a flexible plastic bag supported within a relatively rigid cardboard box. The cardboard box is generally rectangular, which permits storage at the wholesale level without needing crates. In addition, such containers allow the consumer to purchase and store relatively large quantities of such liquids with relative convenience.

A particular spout and spigot assembly has been developed for use with cardboard "bag-in-box" containers that is described in U.S. Pat. No. 4,211,348. This assembly is provided in a first standard diameter for a 5 liter container, and in a second, smaller standard diameter for a 3 liter container. Briefly, the assembly comprises a spout provided in the plastic bag and supported near the bottom of the box, and a spigot attached to the far end of the spout. The spigot has a flexible stop wall with an integral toggle lever, which the user can manipulate to flex the stop wall. When the lever is raised, the stop wall is flexed and a path of egress is opened for the liquid through an opening in the stop wall. When the lever is released, a biasing snap back force acts to return the stop wall back to its unflexed shape, thereby sealing off the egress path.

The aforementioned spigot and spout assembly is now described in detail with reference to FIGS. 1, 2 and 3. Assembly 20 has an annular flange 22 for sealed connection to the flexible plastic bag containing the liquid. Extending from flange 22 is a hollow, typically cylindrical spout 24, with an interior surface 26 and an exterior surface. The exterior surface has outwardly extending flanges 28, which form between them annular grooves 30, 32 and 34. The flanges are included to facilitate filling of the bag with liquid, and to help stabilize, with respect to the cardboard box, the spout in an extended position for dispensing the liquid. The spout is typically made of plastic.

The spigot is indicated as 36, and is attached to the far end of spout 24. The spigot has a cylindrical outer wall 38, a cylindrical inner wall 40, and a flexible, circular inner wall 42, that is otherwise known as stop wall 42. The two cylindrical walls trap between them the far end of the spigot watertightly. The spigot is typically made primarily of rubber material.

The stop wall is disposed transversely to an axis of the spout, and seals it off. An arcuate portion of outer wall 38 is omitted to form opening 44, through which the liquid is dispensed. The outer edge of stop wall 42 has a sealing bead 46, which presses against interior surface 26 of the spout, to seal it off at opening 44.

Integral with stop wall 42 is a resilient, toggle shaped lever 48 extending from stop wall 42. The lever has an inner end, an outer end, and a flat bottom surface 50. The lever is attached to the stop wall by the inner end, and the bottom surface is to be engaged by a finger of the user. As seen in FIG. 3, the user is supposed to push on the bottom surface of the lever to counteract the biasing snap back force. The direction of the force is such that pushing is first upward, then rotates, and then concludes in the direction shown by arrow 51, i.e. upward and also inward. This will cause bottom surface 50 to be tilted upwards about the inner end. Stop wall 42 will be distorted, and sealing bead 46 will be drawn away from interior wall 26, thereby allowing the liquid to flow through opening 44. Upon release of lever 48, stop wall 42 returns to its normal shape by the action of the snap back force. As seen in FIG. 2, the lever in the closed configuration extends horizontally from the stop wall, and the bead seals off further flow of the liquid.

As can be seen, the lever is positioned entirely within the spout. This makes operation of the spigot cumbersome and uncomfortable for the user, as the user must insert a finger or thumb into the small cylindrical recess, and maintain a force on the lever to counteract the force of the snap back action. The force must be maintained at the awkward angle of arrow 51. The force divided by the small area of bottom surface 50 makes for high pressure against the finger of the user. If the pressure is too high, the user applies less force, thereby opening the egress path only narrowly, and the liquid flow rate is slow.

This problem has been addressed in the prior art by adaptor devices such as is taught in U.S. Pat. No. 5,402,919 to Atkinson, and shown in FIG. 4. Device 52 is mounted on spout 24, which is supported on cardboard box 53. The device opens the spigot by lifting lever 48.

More particularly, device 52 includes a semicircular collar 54 that is mounted onto the end of the spout. Strictly speaking, the collar is actually mounted over also outer wall 38 of the spigot. In the art it is said, however, that the collar is mounted onto the spout without mentioning the outer wall of the spigot, because it is the plastic spout that provides mounting stability, not the rubber spigot.

The device also includes an actuator 56 pivotably attached to the collar. The actuator has a handle 58 and a cam 60, that rotate together around a rotation axis 62. When the collar is mounted onto the spout, the actuator becomes positioned relative to the spigot in the standby position of FIG. 4. From there the actuator can open the spigot. Specifically, when handle 58 is rotated from the standby position towards the user and downward, an upper surface of cam 60 pushes lever 48 upwards, thereby dispensing liquid in a receptacle that is placed beneath the opening.

Devices of the prior art have problems. First, the spout and spigot assemblies come in two different diameters. The device can only be used on spouts of a single diameter. Thus a different device is required for a spout of a different diameter.

A second such problem arises from fact that the device wobbles and shifts around on the spout, since the mere mounting of the collar onto the spout does not also secure it.

A third set of problems arise from inadequacies in the design of the cam. Cam 60 pushes lever 48 upwards, but never opens the egress path fully, because of the danger of overrotation. Overrotation is undesirable because it will cause the lever to fall off the cam irreversibly, and the snap back force will cause the spigot to shut off. Then the device will have to be removed, the handle put back in the standby position, and the device remounted. To prevent such overrotation, Atkinson teaches to add a rotation stop tab 64. Tab 64 prevents further rotation of the actuator by itself running into the lower rim of the spout, but still does not allow the egress path to be opened the widest.

BRIEF SUMMARY OF THE INVENTION

Generally, the present invention provides an improved spigot actuating device that overcomes these problems and limitations of the prior art. The device comprises a collar and an actuator that is pivotable with respect to the collar around a rotation axis. The collar is mounted onto a spout of the large standard diameter. The actuator has a handle for the user, and a cam with a specially designed upper surface. As the handle is rotated from the standby position, the upper surface engages the lever and pushes it against the snap back force. In addition, the device of the invention includes improvements over the prior art.

The invention provides a spacer in the shape of an arcuate cuff. The spacer has an inside diameter suitable for mounting onto a spout of a standard small diameter. The spacer has the proper radial thickness to emulate a spout of the large standard diameter. The spacer includes ribs for preventing the collar from sliding off. Use of the spacer of the invention permits procuring a single spigot actuating device for use with spouts of all diameters.

In the preferred embodiment the collar is flexible and resilient, arcuate, terminates in legs, and extends around the spout more than half way. The collar is sized to mount graspingly onto a spout of standard large diameter. Mounting graspingly is by the collar contacting with pressure at least one contact section of the spout. The contact sections belong in a grasp arc that belongs in the circumference of the spout and is larger than 180°, which makes for a secure attachment. Further, teeth are preferably provided on the collar to better grasp the spout with.

The device legs are separable, to permit mounting graspingly the collar onto the spout, and removing it afterwards. Preferably a pair of pinchers are provided on the collar, that can be squeezed together to increase the separation between the legs.

In addition, the cam presents an upper surface that is approximately semicylindrical, around a cam axis parallel to the rotation axis and with a radius of about 0.7 cm. Such results in a natural stop to rotation of the handle, by the upper surface running into an inside surface of the spout. The natural stop obviates the need for including a stop tab, and is designed to occur at a full open position of the actuator. The full open position is such that (a) the resulting egress path for the liquid is the widest possible, and (b) the snap back force is applied exclusively to the rotation axis, and no longer against the user's hand. Accordingly it is possible to release the handle entirely while the egress path is maintained at its widest. This is particularly useful when the container is almost empty, and it needs to be picked up and tilted.

These and other features of the present invention will be apparent from the preferred embodiment described in the following detailed description and illustrated in the accompanying drawings.

DETAILED DESCRIPTION OF THE INVENTION

Figure 1:
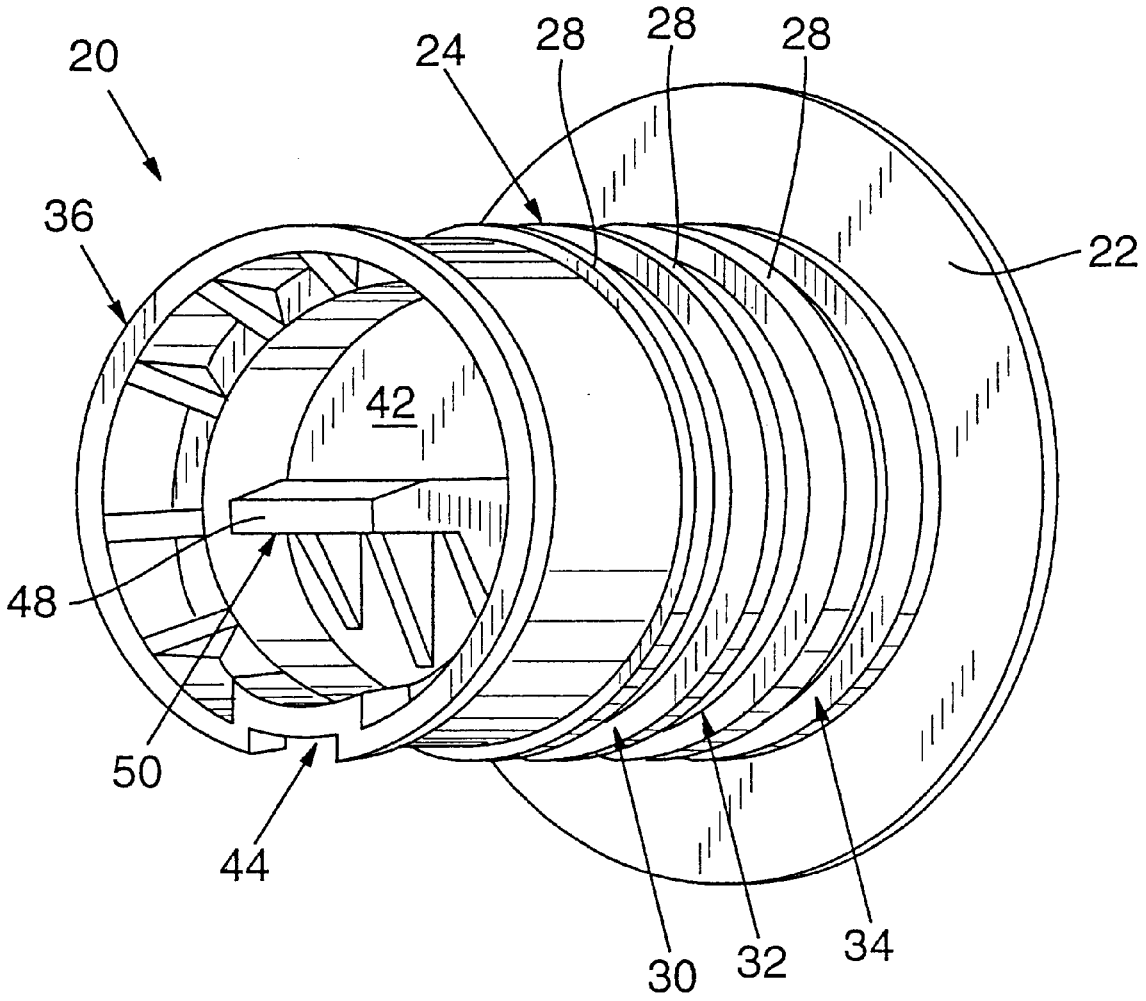
FIG. 1 (Prior Art)
FIG. 1 is a perspective view of a spigot and spout assembly in the prior art.
Figure 2:
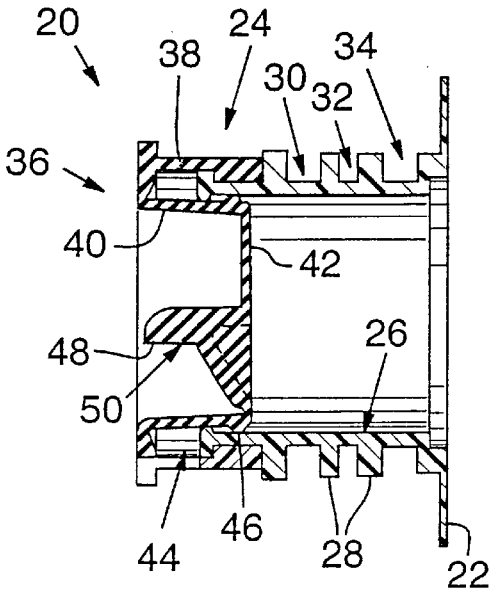
FIG. 2 (Prior Art)
FIG. 2 is a sectional view of the assembly of FIG. 1, wherein the lever is in the closed configuration.
Figure 3:
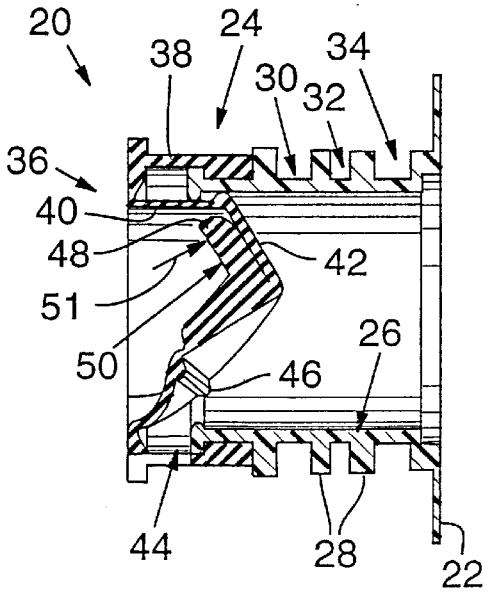
FIG. 3 (Prior Art)
FIG. 3 is a sectional view of the assembly of FIG. 1, wherein the lever is in the open configuration.
Figure 4:
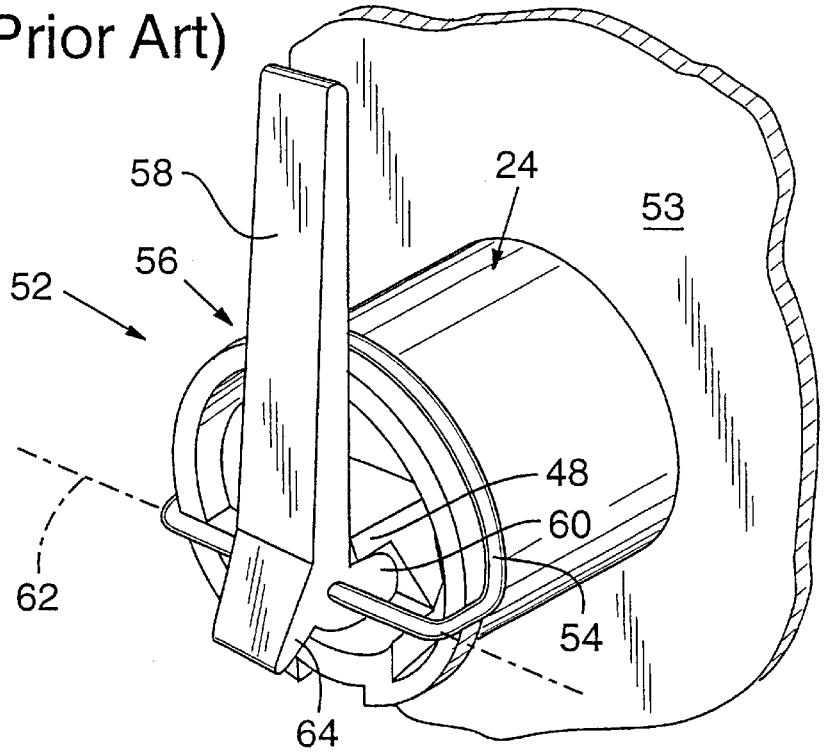
FIG. 4 (Prior Art)
FIG. 4 shows a spigot actuating device in the prior art that has been mounted onto the spigot and spout assembly of FIG. 1, and wherein the actuator is in the standby position.

As has been mentioned, the present invention provides a device for actuating the spigot of containers that are made as described in FIGS. 1, 2 and 3. The device of the invention comprises a collar and an actuator that is pivotable with respect to the collar, and further includes many improvements over similar devices of the prior art. The various improvements disclosed and claimed in this document can be practiced independently of each other. The preferred embodiment of the invention includes all the improvements.

Figure 5:
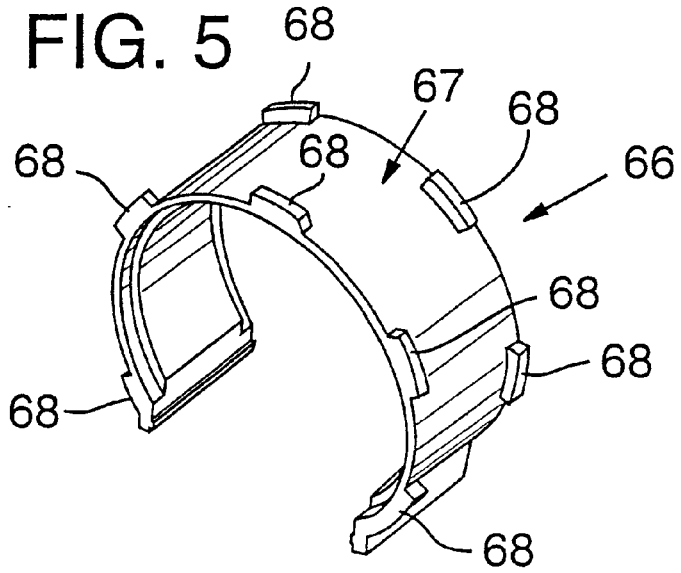
FIG. 5 is a perspective view of a spacer made according to the invention.
Figure 6:
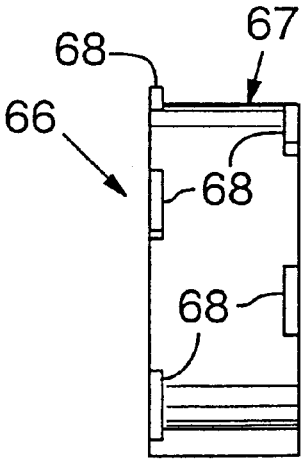
FIG. 6 is a side view of the spacer of FIG. 5.
Figure 7:
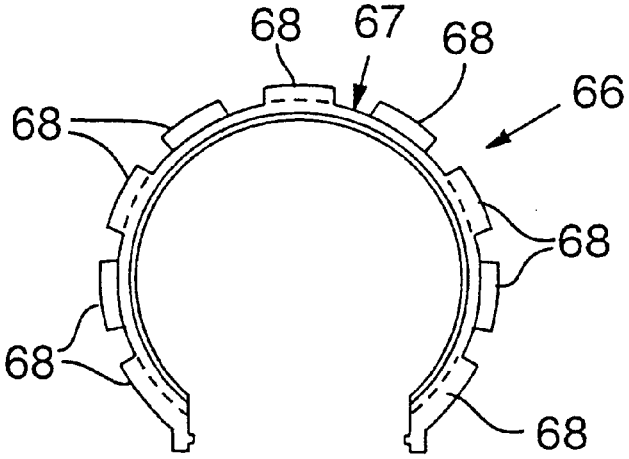
FIG. 7 is a front view of the spacer of FIG. 5.

The collar of the device of the invention is preferably sized for mounting onto a spout of the large standard diameter. The invention then further provides a spacer that is now described with reference to FIGS. 5–7. Spacer 66 is shaped so that it can be mounted onto a spout of the smaller standard diameter. That is, it has an inner surface that is typically cylindrical, and of a diameter equal to that of the small spout. The spacer is preferably made from resilient and flexible material, so that it can be snapped onto the small spout.

The spacer defines an outer surface 67 for the collar of the device to be mounted onto, as if the outer surface where the spout of a large standard diameter. So, preferably the outer surface is generally shaped as a portion of a cylinder, and specifically the whole spacer has the shape of the arcuate cuff of FIGS. 5–7.

Spacer 66 preferably further includes retention means 68 bordering outer surface 67. The retention means is for preventing the mounted collar from slipping off the outer surface. The preferred retention means is ribs 68 placed in alternating locations to facilitate manufacturing.

As can be surmised, spacer 66 corrects for the problem of different diameters, and presents a single spout diameter that needs to be addressed. Therefore a single spigot actuating device need be procured, one with a collar sized for the large only standard diameter. The subsequent discussion is for collars of only the large diameter, but is intended as applying equally to spouts of all diameters, since they can be adjusted by using a spacer made according to the invention. Furthermore, the special properties of the cam (that are described below) hold true also for spouts of both sizes.

Figure 8:
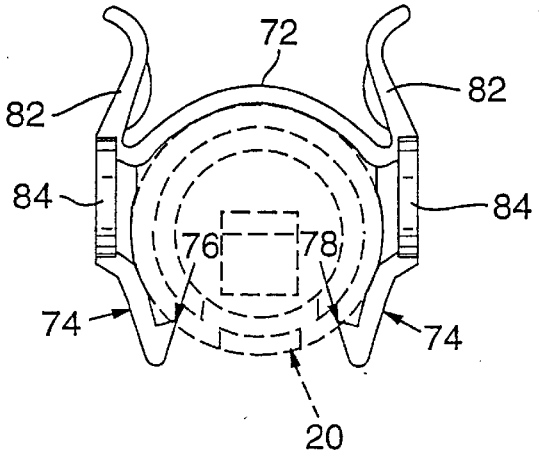
FIG. 8 is a front view of the collar of a device made according to the invention, shown mounted graspingly onto a spout, and with the actuator removed.

The preferred collar of the device of the invention is now described with reference to FIG. 8. Collar 72 is arcuate, and terminates in legs 74. The collar has a width suitable for fitting exactly between ribs 68.

Collar 72 is properly sized for a spout 20 of the large standard size. For the smaller size, a spacer 66 can be used.

The collar extends around the spout more than half way, i.e. by more than 180° around it. This way it surrounds the centerline of the spout, which results in secure attachment.

The collar is mounted graspingly onto the spout. For purposes of this document, mounting graspingly is defined as the collar contacting with pressure at least one contact section of the spout. Because of the initial shape and resilience of the preferred collar, all the points of the collar that contact the spout do so with pressure, and especially teeth 76, 78. From the point of view of the spout, it is contacted with pressure in at least one contact section. In the embodiment of FIG. 8, it is contacted with pressure in five contact sections (one from the main collar, two from the legs, and two from the teeth). The pressure is heightened at the teeth, because of their small area. The contact sections belong in a so called grasp arc that belongs in the circumference of the spout. Importantly, the grasp arc of the preferred collar is larger than 180°, which results in the attachment being secure.

Legs 74 are made separable manually, so as to enable mounting graspingly the collar onto the spout, and removing it afterwards. Separability may be accomplished in a number of ways, as will be apparent to a person skilled in the art, in view of the present description. One such way is to include a hinge in the collar.

In the preferred collar, separability is accomplished by making the collar resilient and flexible. The legs may be separated manually by brute forcing the collar onto the spout, and off of it afterwards. Such is not preferred, however, since it will result in the teeth (that are described below) scraping the spout. Scraping is undesirable because it may generate rubber particulates that might fall into the liquid.

Teeth 76 and 78 are preferably provided on the collar, to better secure it on the spout. The teeth are preferably provided at the ends of legs 74, and work well because they bite into rubber material, namely outer wall 38 of the spigot covering the spout. In addition, the teeth preferably have surfaces that are perpendicular to the legs, to provide exactly fitting stops for aligning the cuff exactly under the collar.

Preferably pincher means 82 are provided on collar 72. The pincher means are attached to the collar in such a way that applying force relative to the pincher means results in the separation between the collar legs to be increased. The preferred pincher means is a pair of pinchers 82, that can be squeezed together to increase the separation between the legs.

Collar 72 further includes two towers 84 for supporting the actuator, as is described in more detail below.

Figure 9:
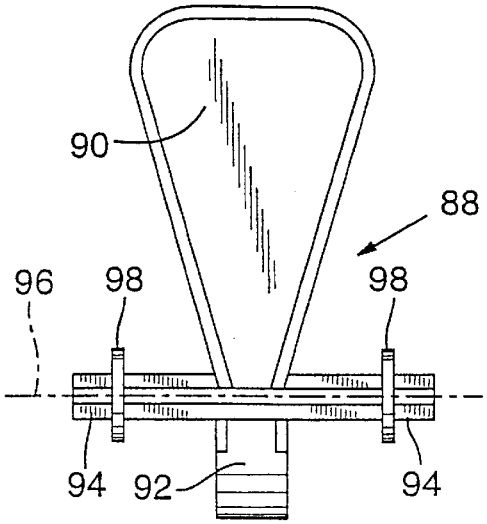
FIG. 9 is a front view of an actuator of a device made according to the invention.

The preferred actuator is now described with reference to FIG. 9. Actuator 88 includes a handle 90 that is preferably flat, so that it can bear a trademark indication. The actuator also includes a specially designed cam 92 that is described in more detail later. The actuator further includes an axle 94 that defines rotation axis 96 of the actuator.

Axle 94 is long enough so that it does not fall through, when the pinchers are squeezed just enough to remove the device from a spigot. Further, the axle includes stops 98, that prevent the axle from sliding laterally when it is supported by the towers.

Additionally the axle is short enough, so that it can be removed from the towers of the collar, when pinchers 82 are squeezed together harder. This removability is to facilitate manufacturing as two separate pieces. Accordingly the collar can indeed be without the actuator (as shown in FIG. 8), and the actuator can indeed be by itself (as shown in FIG. 9).

Figure 10:
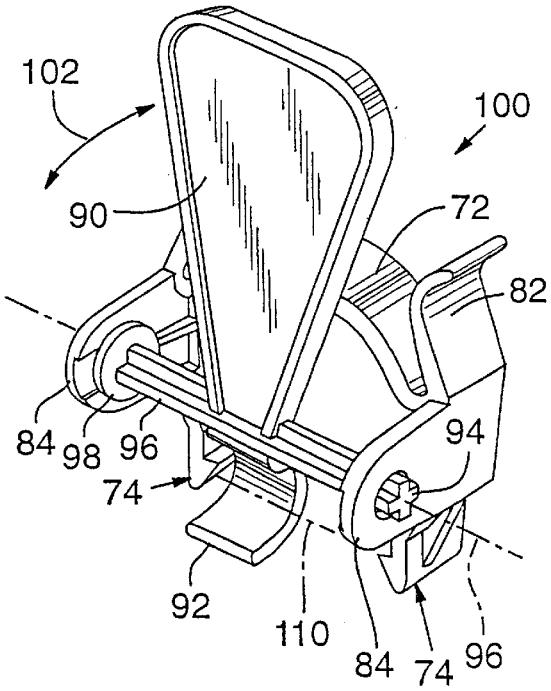
FIG. 10 is a front perspective view of a device made according to the invention.
Figure 11:
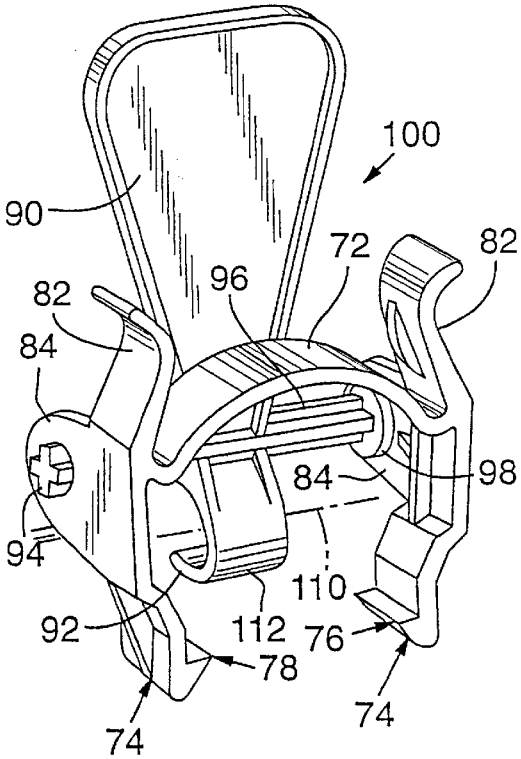
FIG. 11 is a rear perspective view of the device of FIG. 10.

The assembled device of the invention is shown as 100 in FIGS. 10 and 11. The actuator is supported by the towers 84 supporting axle 94 within stop tabs 98. Support is in such a way that the handle and thus the whole actuator can pivot with respect to the collar around rotation axis 96, and according to the direction of arrow 102. As shown, the actuator and the handle are in the standby position.

Cam 92 is specially designed according to the invention. The cam presents an upper surface 112 that is approximately semicylindrical, and ends in a straight tab. The semicylindrical part has a radius of curvature of 0.7+/−0.1 cm around a cam axis 110 that is parallel to rotation axis 96.

Figure 12:
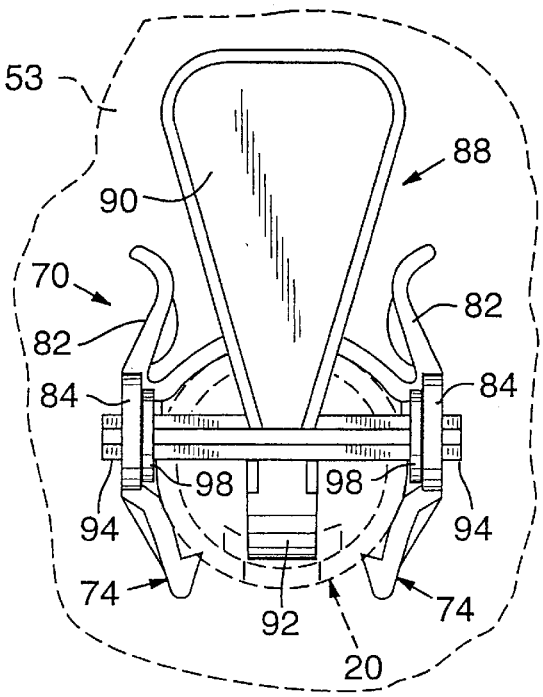
FIG. 12 is a front view of the device of FIG. 10, shown mounted graspingly onto a spout, and with the actuator in the standby position.
Figure 13:
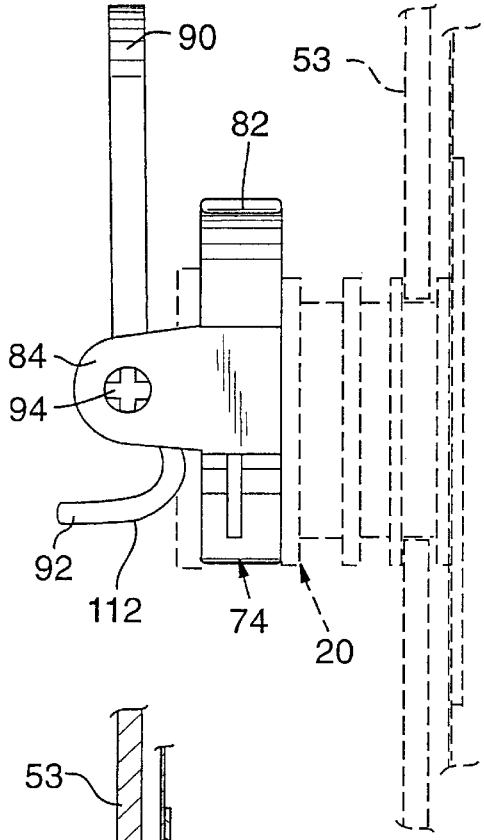
FIG. 13 is a side view of the device of FIG. 12.
Figure 14:
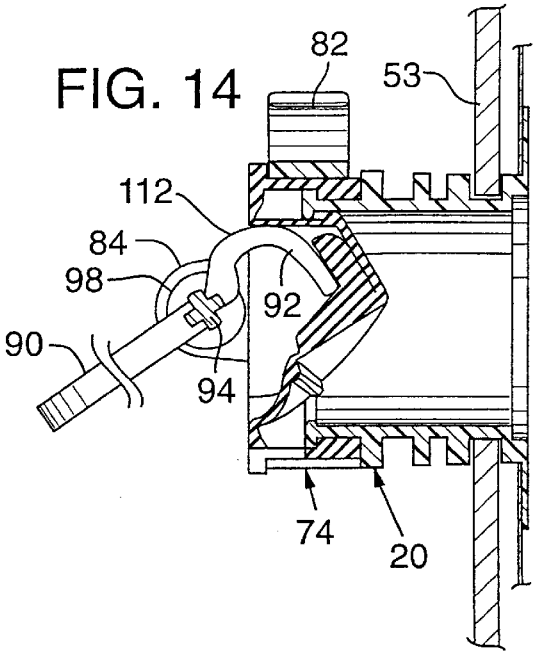
FIG. 14 is a sectional view of the device of FIG. 13, wherein further the actuator has been rotated from the standby position to the full open position.

Device 100 is shown mounted graspingly onto spout 20 in FIGS. 12 and 13, with the actuator in the standby position. From there the handle can be rotated according to arrow 102 of FIG. 10, against the action of the snap back force. The resulting arrangement is seen in FIG. 14. The special design of the cam results in a natural stop to rotation of the handle, by the upper surface 112 running into an inside surface of the spout.

The natural stop is engineered to occur at the position of FIG. 3. This is called a full open position of the actuator, because the resulting egress path for the liquid is the widest possible. Further device 100 is engineered such that, at the full open position, the snap back force is advantageously applied exclusively to the rotation axis, and no longer against the user's hand. This is because axle 94 is placed in the same direction as arrow 51 of the full open position of FIG. 3. Accordingly it is possible to release the handle entirely while the egress path is maintained at its widest. This is particularly useful when the container is almost empty, and it needs to be picked up and tilted.

The device is preferably made out of plastic. ABS plastic is the candidate best addressing the combined requirements of low cost and flexibility and resilience of the spacer and the collar.

In the above description numerous details have been set forth in order to provide a more thorough understanding of the present invention. It will be obvious, however, to one skilled in the art that the present invention may be practiced without these specific details. In other instances, well known features have not been described in detail in order to not obscure unnecessarily the present invention.

The invention claimed is:

1. For use with a container containing a potable liquid and having a spigot for dispensing the liquid, the container further having a projecting substantially cylindrical spout for supporting the spigot therewithin, the spout defining an exterior surface, the spigot having a lever with an inner end and a bottom surface, the lever capable of being in a closed configuration whereby the liquid is not being dispensed, the closed configuration being such that the bottom surface is oriented substantially horizontally, the lever further capable of being in an open configuration whereby the liquid is being dispensed, the open configuration being such that the bottom surface is in an orientation that is tilted upwards about the inner end when compared to the horizontal orientation of the closed configuration, the lever being biased towards the closed configuration by a snap back force, the lever being capable of being placed in the open configuration by a user engaging the bottom surface with a finger and pushing it against the snap back force, a device for placing the lever in the open configuration comprising:

an arcuate spacer adapted for mounting around the exterior surface of the spout;

a collar adapted for mounting onto the spacer after the spacer has been mounted onto the exterior surface of the spout; and an actuator associated with the collar, the actuator including a handle and a cam, the cam having an upper surface that is in a fixed orientation with respect to the handle, wherein when the spacer is mounted onto the spout and the collar is mounted onto the spacer, the handle is pivotable with respect to the collar, and pivoting of the handle with respect to the collar can cause the upper surface of the cam to engage the bottom surface of the lever and to push it against the snap back force.

2. The device of claim 1, wherein the spacer defines an outer surface for the collar to be mounted onto, and wherein the spacer further includes retaining means bordering the outer surface for preventing the mounted collar from slipping off the outer surface.

3. The device of claim 1, wherein the spacer is extendable when a bias is applied for being placed around the exterior surface of the spout, and resilient such that it reacquires the original shape of an arcuate cuff when the bias is released, thereby grasping the exterior surface of the spout.

4. The device of claim 3, wherein the spacer defines an outer surface for the collar to be mounted onto, and wherein the spacer further includes retaining means bordering the outer surface for preventing the mounted collar from slipping off the outer surface.

5. For use with a container containing a potable liquid and having a spigot for dispensing the liquid, the container further having a projecting cylindrical spout for supporting the spigot thereon, the spigot having a lever with an inner end and a bottom surface, the lever capable of being in a closed configuration whereby the liquid is not being dispensed, the closed configuration being such that the bottom surface is oriented substantially horizontally, the lever further capable of being in an open configuration whereby the liquid is being dispensed, the open configuration being such that the bottom surface is in an orientation that is tilted upwards about the inner end when compared to the horizontal orientation of the closed configuration, the lever being biased towards the closed configuration by a snap back force, the lever being capable of being placed in the open configuration by a user engaging the bottom surface with a finger and pushing it against the snap back force, a device for placing the lever in the open configuration comprising:

a collar adapted for mounting graspingly onto the spout, the mounting graspingly being by the collar contacting with pressure at least one contact section of the spout, the contact sections belonging in a grasp arc that belongs in the circumference of the spout and is larger than 180°, the collar terminating in legs, wherein the separation between the legs can be increased manually for mounting graspingly the collar onto the spout, wherein the collar is flexible for being extended when a bias is applied and resilient for reacquiring its shape when the bias is released;

an actuator associated with the collar, the actuator including a handle and a cam, the cam having an upper surface that is in a fixed orientation with respect to the handle, wherein when the collar is mounted graspingly onto the spout the handle is pivotable with respect to the collar, and pivoting of the handle with respect to the collar can cause the upper surface of the cam to engage the bottom surface of the lever and to push it against the snap back force; and two pinchers attached to the collar in such a way that biasing the pinchers towards each other results in the separation between the collar legs to be increased.

6. For use with a container containing a potable liquid and having a spigot for dispensing the liquid, the container further having a projecting cylindrical spout for supporting the spigot thereon, the spigot having a lever with an inner end and a bottom surface, the lever capable of being in a closed configuration whereby the liquid is not being dispensed, the closed configuration being such that the bottom surface is oriented substantially horizontally, the lever further capable of being in an open configuration whereby the liquid is being dispensed, the open configuration being such that the bottom surface is in an orientation that is tilted upwards about the inner end when compared to the horizontal orientation of the closed configuration, the lever being biased towards the closed configuration by a snap back force, the lever being capable of being placed in the open configuration by a user engaging the bottom surface with a finger and pushing it against the snap back force, a device for placing the lever in the open configuration comprising:

a collar adapted for mounting graspingly onto the spout, the mounting graspingly being by the collar contacting with pressure at least one contact section of the spout, the contact sections belonging in a grasp arc that belongs in the circumference of the spout and is larger than 180°, the collar terminating in legs, wherein the separation between the legs can be increased manually for mounting graspingly the collar onto the spout;

an actuator associated with the collar, the actuator including a handle and a cam, the cam having an upper surface that is in a fixed orientation with respect to the handle, wherein when the collar is mounted graspingly onto the spout the handle is pivotable with respect to the collar, and pivoting of the handle with respect to the collar can cause the upper surface of the cam to engage the bottom surface of the lever and to push it against the snap back force; and teeth attached to the collar, the teeth oriented so that they contact the spout when the collar is mounted graspingly onto the spout.

7. The device of claim 6, wherein the collar is flexible for being extended when a bias is applied and resilient for reacquiring its shape when the bias is released, and wherein the device further comprises two pinchers attached to the collar in such a way that biasing the pinchers towards each other results in the separation between the collar legs to be increased.

8. For use with a container containing a potable liquid and having a spigot for dispensing the liquid, the container further having a projecting substantially cylindrical spout for supporting the spigot therewithin, the spigot having a lever with an inner end and a bottom surface, the lever capable of being in a closed configuration whereby the liquid is not being dispensed, the closed configuration being such that the bottom surface is oriented substantially horizontally, the lever further capable of being in an open configuration whereby the liquid is being dispensed, the open configuration being such that the bottom surface is in an orientation that is tilted upwards about the inner end when compared to the horizontal orientation of the closed configuration, the lever being biased towards the closed configuration by a snap back force, the lever being capable of being placed in the open configuration by a user engaging the bottom surface with a finger and pushing it against the snap back force, a device for placing the lever in the open configuration comprising:

a collar adapted for mounting onto the spout; and an actuator associated with the collar, the actuator including a handle, a cam and an axle, the cam having an upper surface that is in a fixed orientation with respect to the handle, wherein when the collar is mounted onto the spout the handle is pivotable with respect to the collar around the axle, and pivoting of the handle with respect to the collar around the axle can cause the upper surface of the cam to engage the bottom surface of the lever and to push it against the snap back force, and wherein the actuator is configured such that the handle can be pivoted to a position where the snap back force is applied exclusively against the axle.

9. The device of claim 8, further comprising a spacer interposed between the collar and the spout.

10. The device of claim 8, wherein the collar clamps onto the spout.

11. The device of claim 10, further comprising a spacer interposed between the collar and the spout.

12. For use with a container containing a potable liquid and having a spigot for dispensing the liquid, the container further having a projecting substantially cylindrical spout for supporting the spigot therewithin, the spigot having a lever with an inner end and a bottom surface, the lever capable of being in a closed configuration whereby the liquid is not being dispensed, the closed configuration being such that the bottom surface is oriented substantially horizontally, the lever further capable of being in an open configuration whereby the liquid is being dispensed, the open configuration being such that the bottom surface is in an orientation that is tilted upwards about the inner end when compared to the horizontal orientation of the closed configuration, the lever being biased towards the closed configuration by a snap back force, the lever being capable of being placed in the open configuration by a user engaging the bottom surface with a finger and pushing it against the snap back force, a device for placing the lever in the open configuration comprising:

a collar adapted for mounting onto the spout; and an actuator associated with the collar, the actuator including a handle and a cam, the cam having an upper surface that is in a fixed orientation with respect to the handle, wherein when the collar is mounted onto the spout the handle is pivotable with respect to the collar around a rotation axis, and pivoting of the handle with respect to the collar around the rotation axis can cause the upper surface of the cam to engage the bottom surface of the lever and to push it against the snap back force, and wherein the upper surface is approximately semicylindrical around a cam axis parallel to the rotation axis and with a radius of curvature of about 0.7+/−0.1 cm, and ends in a straight tab.

13. The device of claim 12, further comprising a spacer interposed between the collar and the spout.

14. The device of claim 12, wherein the collar clamps onto the spout.

15. The device of claim 14, further comprising a spacer interposed between the collar and the spout.

* * * * *